US006758139B2

(12) United States Patent
Knoll

(10) Patent No.: US 6,758,139 B2
(45) Date of Patent: Jul. 6, 2004

(54) CYLINDER

(75) Inventor: Wolfgang Knoll, Lambsheim (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 0 days.

(21) Appl. No.: 10/275,266

(22) PCT Filed: Jan. 26, 2001

(86) PCT No.: PCT/DE01/00321

§ 371 (c)(1),
(2), (4) Date: Apr. 10, 2003

(87) PCT Pub. No.: WO01/85454

PCT Pub. Date: Nov. 15, 2001

(65) Prior Publication Data

US 2003/0154872 A1 Aug. 21, 2003

(30) Foreign Application Priority Data

May 12, 2000 (DE) ..... 100 23 205

(51) Int. Cl.[7] ..... B41F 13/10
(52) U.S. Cl. ..... 101/375; 492/7
(58) Field of Search ..... 101/136, 141, 101/152, 153, 174, 212, 216, 219, 375, 376, 217, 218; 492/2, 6, 7, 5, 16

(56) References Cited

U.S. PATENT DOCUMENTS

| | | | | |
|---|---|---|---|---|
| 3,389,450 A | | 6/1968 | Robertson | |
| 3,704,669 A | * | 12/1972 | Christoff | 101/350.3 |
| 4,438,695 A | | 3/1984 | Maier et al. | |
| 4,455,727 A | | 6/1984 | Tschirner | |
| 4,637,109 A | | 1/1987 | Bryer | |
| 4,913,051 A | | 4/1990 | Molinatto | |
| 5,174,206 A | | 12/1992 | Molinatto | |
| 6,164,207 A | * | 12/2000 | Junghans | 101/487 |

FOREIGN PATENT DOCUMENTS

| | | |
|---|---|---|
| DE | 30 33 230 A1 | 3/1982 |
| DE | 30 33 230 C2 | 8/1983 |
| DE | 0 491 112 A1 | 6/1992 |

* cited by examiner

*Primary Examiner*—Ren Yan
(74) *Attorney, Agent, or Firm*—Jones, Tullar & Cooper PC

(57) ABSTRACT

The invention relates to a cylinder in a rotary press, in particular, for interacting with a form cylinder for a gravure press. According to the invention, the cylinder is improved with regard to its variable adaptability by the provision of a linear drive located at the end of the cylinder between the fixed support and rotating outer surface. Said linear drive operates in a vertical radial direction upwards toward the inner ring of a roller bearing,

22 Claims, 1 Drawing Sheet

CYLINDER

Cylinder

Figure 1:
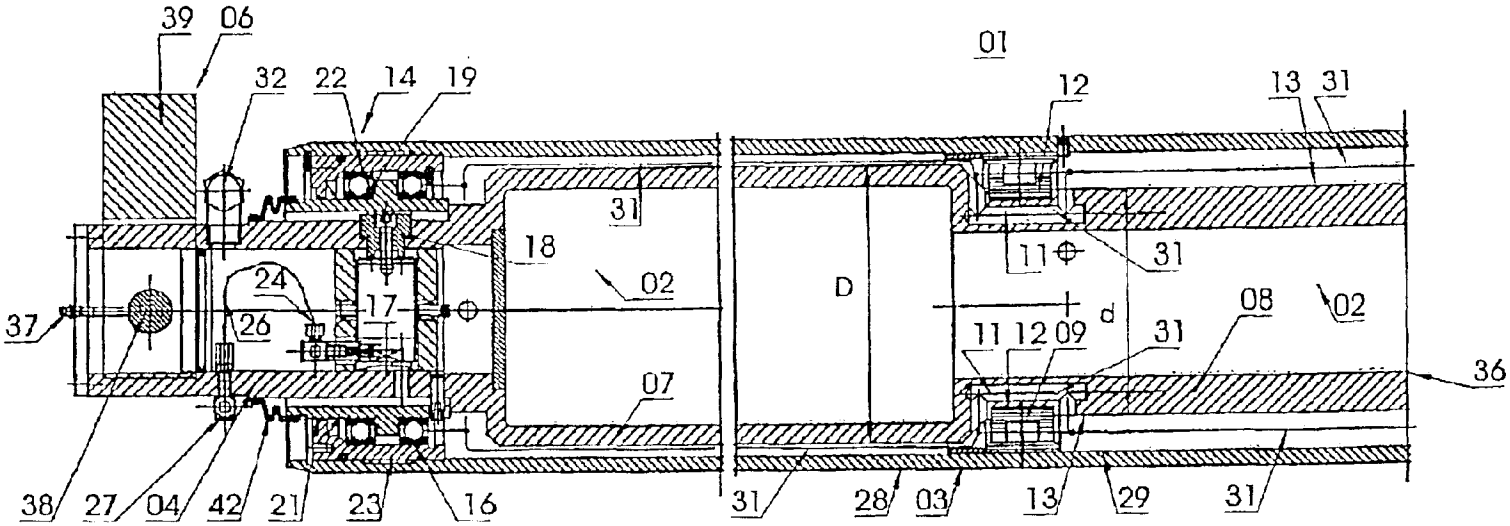

The invention relates to a cylinder in accordance with the preamble of claim 1.

A counter-pressure cylinder has become known from DE 30 33 230 C2, whose journal is held in end plates. In this case an actuating element acts on each of the free ends of the journals protruding out of the end plates for the metered introduction of pressure forces for the purpose of compensating the sagging of the cylinder.

U.S. Pat. No. 4,913,051 discloses a cylinder of a rotary printing press, wherein a jacket of the cylinder is seated by means of rolling bearings on a support. A distance in the radial direction between the jacket and the support at the ends is permanently fixed by means of the rolling bearings. Further rolling bearings with adjusting means for changing the distance between the jacket and the support are arranged between these rolling bearings.

The object of the invention is based on creating a cylinder.

In accordance with the invention, this object is attained by means of the characteristics of claim 1.

The advantages to be achieved by the present invention reside primarily in that an introduction of the placement force takes place via the shaft and the bearings arranged between the jacket and the shaft. Because of this, tube bending, which corresponds to the tendency of the cylinder to bend, already occurs when the cylinder is put down. The bending compensation takes place via the exterior bearings.

By arranging a bearing with an adjustment drive at the ends of the jacket, weakening because of the space requirements of the adjustment drive becomes necessary only in the area of the ends of the support, or jacket. In contrast to actuating drives located in the interior, this results in an improved flexural strength.

The interior and exterior bearings are placed within a common hydraulic fluid circuit, therefore later greasing of the bearings is not necessary. Further than that, a permanent fluid circulation between both ends of the counter-pressure cylinder leads to the removal of the heat from the rubber-coated cylinder jacket, which was generated by the flexing of the rubber blanket.

A shorter shaft distance and a shorter total length result because all bearing points are housed inside the tube jacket, an improved installation possibility is created because of this, also when retrofitting existing presses.

The design of the shaft seating makes assembly and disassembly easier in comparison with known embodiments.

An exemplary embodiment of the invention is represented in the drawings and will be described in greater detail in what follows.

Figure 2:
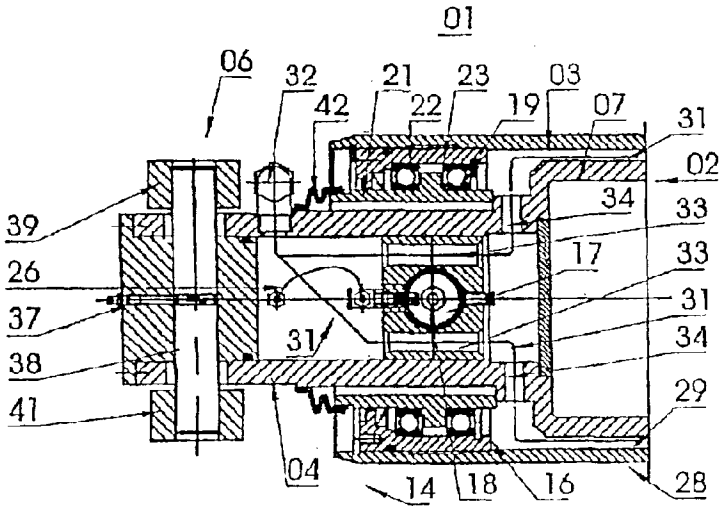

Shown are in:

FIG. 1, a schematic representation of a longitudinal sectional view through the left portion of a cylinder in the vertical direction, FIG. 2, a portion of the longitudinal section in FIG. 1, but in the horizontal direction.

A cylinder 01, for example a counter-pressure cylinder 01, in particular an impression cylinder for a rotogravure forme cylinder, for example in a rotary printing press, consists of a shaft or support 02 with a rotatable tube-shaped jacket 03, whose journals 04 are seated, fixed against relative rotation, in a bearing and lifting device 06. The support 02 located between the journals can be made of several parts and can consist, for example, of a shaft 07 in the form of a hollow cylinder of a greater diameter D and a tube 08 of a lesser diameter d, which is seated between these shafts 07.

Rolling bearings 09, for example in the form of cylindrical roller bearings 09, are arranged between the rotatable tube-shaped jacket 03 and the stationary support 02, as seen in FIG. 1. The tube 08 is formed with thick walls and has several bypasses or axially extending passages 11 on its circumference, which axially extending passages 11 are conducted around the profile of an inner ring 12 of the cylindrical rolling bearing 09 and which terminate with their respective openings at the exterior of the tube 08.

Each end 14 of the jacket 03 is seated by means of a rolling bearing 16, for example a deep groove ball bearing 16, on the respective journal 04 of the support 02. An actuating device 17, for example a working cylinder 17, is arranged between the support 02 and the jacket 03, whose tappet 18 acts in a vertical radial direction away from the support 02 upward against an inner ring 19 of the deep groove ball bearing 16.

A rolling bearing 16 with an actuating drive 17 for changing the distance between the jacket 03 and the support in the radial direction is arranged in the area of each end 14 of the jacket 03. One or two rolling bearings 09 without the capability of changing the distance between the jacket 03 and the support in the radial direction are arranged between these rolling bearings 16 with actuating drives 17.

The inner ring 19 of each deep groove ball bearing 16 is supported by a bushing 21. The outer ring 22 of the deep groove ball bearing 16 is surrounded by a concentrically arranged bushing 23.

Each working cylinder 17 has a fluid feed 24, which is connected via a line 26, for example a high-pressure hose, screw connection 27 and further lines with a hydraulic oil source, not represented. Depending on the requirements, the working cylinders 17 arranged on both ends can be actuated individually or together.

On its outer surface 28, the jacket 03 has an elastic cover, for example made of caoutchouc, not represented.

On its inner surface 29, the rotatable jacket 03 of the counter-pressure cylinder 01 comes into contact with a fluid, for example oil from a lubricant and coolant circuit 31. The lubricant and coolant circuit 31 extends from a first fluid inlet or outlet 32 in the first hollow journal 04 to a second fluid inlet or outlet in the second hollow journal, not represented.

In a flow direction from right to left, axial bores 33 extend on both sides of the working cylinder 17, and radial bores 34 in the journal 04 follow them (FIG. 2). The fluid is further conducted in a space between the support 02 of the diameter D, d, and the inner surface 29 of the jacket 03. Thereafter, the fluid runs to the bypasses 11 and enters through the outlets into the space between the exterior 13 of the tube 08 with the diameter d and the inner surface 29 of the jacket 03.

Behind a succeeding vertically extending center line 36, the counter-pressure cylinder 01 extends laterally reversed (FIG. 1), i.e. the fluid reaches the fluid inlet or outlet 32 in the right journal 04 in the reversed sequence of the above description.

The rolling bearings 09, 16 are lubricated by means of this fluid flow, and the inner surface 29 of the jacket 03 is cooled. The lubricant and coolant circuit 31 is operated at a fluid pressure starting at approximately two bar, in particular at approximately five bar. The throughput of fluid is at least 10 l/m, preferably approximately 30 l/min. Because of the flexing of the rubber blanket, the inlet temperature of the fluid of approximately 18° C. rises to an outlet temperature of more than 40° C. The fluid is cooled down to the previously mentioned inlet temperature by a lubricant-coolant circuit, not represented.

The bearing and lifting device 06 consists of a bearing bolt 38, which is secured by means of screws 37 and passes through the journal 04 and is furthermore seated in height-adjustable lifting arms 39, 41.

The multi-part support 02 can be screwed or welded together at points which are not represented.

A sealing element 42, for example a bellows 42, is arranged between the outer circumference of the journal 04 and the bushing 21 for preventing the fluid from being forced out.

It is possible to set a bending line for different forme cylinders with different diameters by means of varying the exerted bending pressure of the working cylinder 17 on the ends 14 of the tube-shaped jacket 03, for example with a pressure between 10 and 95 bar. Thus, for forme cylinders with a reduced circumference of approximately 800 mm, a pressure of approximately 90 bar can be provided, and for forme cylinders of a circumference of approximately 1,700 mm, a pressure of approximately ten bar can be provided.

The jacket 03 can selectively be made of steel or aluminum, for example.

What is claimed is:

1. A cylinder comprising:

an inner, stationary support, said support having a first end and second end;

an outer rotatable jacket on said support;

at least first and second rolling bearings positioned between said support and said jacket, said rolling bearings supporting said jacket for rotation about said support;

a lubricant and coolant fluid circuit between said support and said jacket, said at least first and second rolling bearings being in contact with a fluid in said lubricant and coolant fluid circuit;

a fluid inlet located at one of said first and said second ends of said support and a fluid outlet located at the other of said first and said second ends of said support; and at least one actuating device engageable with a first one of said rolling bearings, said actuating device being operable to vary a first radial spacing between said jacket and said support, said second rolling bearing fixing a second radial spacing between said jacket and said support, said first rolling bearing and said actuating device being arranged at a first end of said jacket.

2. The cylinder of claim 1 further including a third rolling bearing and a second actuating device arranged at a second end of said jacket, said third rolling bearing being in contact with said fluid in said lubricant and coolant fluid circuit.

3. The cylinder of claim 2 wherein said second rolling bearing is between said first and third rolling bearings.

4. The cylinder of claim 1 wherein said first rolling bearing is a deep groove ball bearing.

5. The cylinder of claim 1 wherein said actuating device is a working cylinder.

6. The cylinder of claim 5 wherein said working cylinder is adapted to be charged with a working fluid at a hydraulic pressure of between 10 bar and 95 bar.

7. The cylinder of claim 5 further including an inner ring of said first rolling bearing, said working cylinder acting against said inner ring.

8. The cylinder of claim 7 further including a bushing supporting said inner ring.

9. The cylinder of claim 5 further including an outer ring in said at least first rolling bearing and a concentrically arranged bushing supporting said outer ring.

10. The cylinder of claim 1 further including an outer surface for said jacket and an elastic cover on said outer surface.

11. The cylinder of claim 1 wherein said fluid inlet and said fluid outlet are sized to convey at least ten liters of fluid/minute.

12. The cylinder of claim 1 wherein said fluid has a pressure of at least two bar.

13. The cylinder of claim 1 wherein said cylinder is arranged in a rotary printing press.

14. The cylinder of claim 1 wherein said cylinder is a counter-pressure cylinder.

15. The cylinder of claim 14 wherein said counter-pressure cylinder is arranged in a rotogravure printing press.

16. A cylinder comprising:

an inner, stationary support, said support having a first end and second end;

an outer rotatable jacket on said support;

at least first and second rolling bearings positioned between said support and said jacket, said at least first and second rolling bearings supporting said jacket for rotation about said support, said first rolling bearing being arranged at said first end of said support and said second rolling bearing arranged at said second end of said support;

at least one fixed set of rolling bearings arranged between said first and said second rolling bearings;

a first actuating device at said first end of said support and a second actuating device at said second end of said support, said first actuating device being engageable with said first rolling bearing and said second actuating device being engageable with said second rolling bearing, each of said actuating devices including a working cylinder with a single push rod; and each of said first and said second actuating devices being operable to vary a first radial spacing between said jacket and said support, said at least one fixed set of rolling bearings fixing a second radial spacing between said jacket and said support.

17. The cylinder of claim 16 wherein each of said first and said second rolling bearings are deep groove ball bearings.

18. The cylinder of claim 16 wherein said working cylinder is adapted to be charged with a working fluid at a hydraulic pressure of between 10 bar and 95 bar.

19. The cylinder of claim 16 further including a lubricant and coolant fluid circuit between said support and said jacket, each of said first rolling bearing, said second rolling bearing, and said at least one fixed set of rolling bearings being in contact with a fluid in said lubricant and coolant fluid circuit.

20. The cylinder of claim 19 said jacket having an inner surface in contact with said fluid in said lubricant and coolant fluid circuit.

21. The cylinder of claim 19 further including a fluid inlet located at one of said first and said second ends of said support and a fluid outlet located at the other of said first and said second ends of said support, each of said fluid inlet and said fluid outlet being sized to convey at least ten liter of fluid/minute.

22. The cylinder of claim 19 wherein said fluid has a pressure of at least two bar.

* * * * *